US007309027B2

(12) United States Patent
Magel et al.

(10) Patent No.: US 7,309,027 B2
(45) Date of Patent: Dec. 18, 2007

(54) FUEL INJECTOR FOR INTERNAL COMBUSTION ENGINES

(75) Inventors: Hans-Christoph Magel, Pfullingen (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/362,747

(22) Filed: Feb. 28, 2006

(65) Prior Publication Data

US 2006/0196975 A1 Sep. 7, 2006

(30) Foreign Application Priority Data

Mar. 1, 2005 (DE) ..... 10 2005 009 147

(51) Int. Cl.
*F02M 47/02* (2006.01)

(52) U.S. Cl. ..... 239/88; 239/90; 239/91; 239/102.2; 239/533.2; 251/129.06

(58) Field of Classification Search ..... 239/533.2, 239/88, 89, 90, 124, 102.1, 102.2; 251/129.06; 123/498

See application file for complete search history.

(56) References Cited

U.S. PATENT DOCUMENTS

| | | | | |
|---|---|---|---|---|
| 5,779,149 | A * | 7/1998 | Hayes, Jr. | 239/124 |
| 6,715,695 | B2 * | 4/2004 | Lorraine | 239/102.2 |
| 6,789,743 | B2 * | 9/2004 | Baranowski et al. | 239/124 |
| 6,805,101 | B2 * | 10/2004 | Magel | 123/467 |
| 6,899,284 | B1 * | 5/2005 | Bocking | 239/102.2 |

* cited by examiner

*Primary Examiner*—Dinh Q. Nguyen
(74) *Attorney, Agent, or Firm*—Ronald E. Greigg

(57) ABSTRACT

A fuel injector for injecting fuel that is at high pressure into a combustion chamber of an internal combustion engine has an injection valve member triggered by an actuator and a coupler chamber; the actuator acts on the injection valve member and the injection valve member opens or closes at least one injection opening. The coupler chamber is located on the side of the actuator diametrically opposite the injection valve member; and the coupler chamber is filled with fuel that is at system pressure when the injection opening is closed.

19 Claims, 3 Drawing Sheets

FUEL INJECTOR FOR INTERNAL COMBUSTION ENGINES

CROSS-REFERENCE TO RELATED APPLICATIONS

This application is a German Patent Application 10 2005 009 147.4 filed Mar. 1, 2005, upon which priority is claimed.

BACKGROUND OF THE INVENTION

1. Field of the Invention

The invention relates to an improved fuel injector for an internal combustion engine.

2. Description of the Prior Art

At present, for introducing fuel into direct-injection, self-igniting internal combustion engines, stroke-controlled high-pressure reservoir systems (common rails) are also used. An advantage of the stroke-controlled systems is that the injection pressure can be adapted to the load and rpm. The stroke-controlled high-pressure reservoir injectors used at present include a piezoelectric actuator and a 3/2-way control valve for controlling the pressure in the needle control chamber. The injection valve member is controlled via a servo control chamber.

By means of an injection valve member controlled directly by the piezoelectric actuator, the opening and closing speed of the injection valve member can be increased compared to presently known injectors. A simpler injector construction is also possible. To achieve the necessary nozzle needle stroke, however, a very long piezoelectric actuator is necessary. A fuel injector with an injection valve member controlled directly by a piezoelectric actuator is known for instance from European Patent Disclosure EP A 0 995 901. This fuel injector includes an injection valve member, which opens or closes an injection opening into a combustion chamber of the engine. On the side of the injection valve member remote from the injection opening, there is a piezoelectric actuator in the injector housing. The piezoelectric actuator acts on a threaded rod, which in turns acts on the injection valve member via a spring element. The piezoelectric actuator is made with a very long length, in order to attain the necessary nozzle needle stroke.

To shorten the length of the piezoelectric actuator, a fuel injector is known from German Patent Disclosure DE A 102 20 498 in which a piezoelectric actuator controls a needle valve motion via a final control element motion-amplifying lever. The piezoelectric actuator acts on one side of the final control element motion-amplifying lever, which as a result experiences a rotary motion and thus with its other side triggers an injection valve member, which opens or closes injection openings.

OBJECT AND SUMMARY OF THE INVENTION

In the fuel injector proposed according to the invention, with an injection valve member which is triggered directly by an actuator and which may be embodied as a nozzle needle, a shortening of the actuator is achieved by providing that the coupler chamber is disposed on a side of the actuator diametrically opposite the injection valve member, that is, the actuator is located between the coupler chamber and the injection valve member, and when the injection opening is closed is filled with fuel that is at system pressure.

An advantage of the disposition according to the invention of the coupler chamber on the side of the actuator remote from the injection valve member is a simplification of the structural makeup of the fuel injector. The mechanical rigidities are also increased, and the hydraulic idle volume in the coupler chamber is reduced still further, compared to the injectors known from the prior art. Moreover, because of the disposition of the coupler chamber on the side of the actuator remote from the injection valve member, both a compensation for production variations and a compensation for temperature expansions are made possible. The direct triggering of the injection valve member and the disposition of the coupler chamber on the side of the actuator remote from the injection valve member permit the exact metering of small fuel quantities into the combustion chamber of the engine.

In one embodiment, the actuator, preferably a piezoelectric actuator, is subjected to voltage when the injection openings are closed and thus has its maximum length in that situation. For opening the injection openings, the electrical voltage is reduced, and the actuator becomes shorter. This triggering, in which the actuator is supplied with current when the injection openings are closed and thus has its maximum length, and in which the supply of current is terminated to open the injection openings, as a result of the actuator becoming shorter, is also known as inverse triggering. Because of the shortening of the actuator, the actuator moves out of the coupler chamber. The volume of the coupler chamber is increased, and as a result the pressure in the coupler chamber drops. The actuator is received in a hollow chamber in the injector body. The hollow chamber is filled with fuel that is at system pressure. Because of the decreasing pressure in the coupler chamber, the force acting on an end face of the actuator, defining the coupler chamber, or on an end face of a piston defining the coupler chamber, which piston is in communication with the end face of the actuator pointing in the direction of the coupler chamber, decreases, and the actuator is moved in the direction of the coupler chamber.

The injection valve member is initially raised from its seat because of the shortening of the actuator and thus uncovers the injection openings. An increase in the length of the stroke of the injection valve member is attained by providing that the actuator is moved in the direction of the coupler chamber that is located on the side of the actuator diametrically opposite the injection valve member.

In a further embodiment, the actuator is in communication, on the side remote from the injection valve member, with a piston which, with a face end remote from the actuator defines a control chamber in a cup-shaped piston. The cup-shaped piston, with one face end toward the actuator, defines the coupler chamber. In this embodiment, the injection openings are closed when there is no current to the actuator.

With an inversely triggered actuator, or in other words when the actuator is supplied with current while the injection openings are closed, the actuator in one embodiment is in communication, on the side remote from the injection valve member, with a cup-shaped piston, and a further piston, which defines a control chamber in the cup-shaped piston, is received in the cup-shaped piston. With a face end remote from the actuator, the cup-shaped piston defines the coupler chamber. In this case, the actuator is supported in floating fashion in a hollow chamber in the injector body. As soon as the injection openings are to be opened, the electrical voltage at the actuator is withdrawn, and the actuator contracts. As a result, the cup-shaped piston is moved out of the coupler chamber, thus increasing the volume of the coupler chamber. Because of the increasing volume, the pressure in the coupler chamber drops. Because of the decreasing pressure in the coupler chamber, the cup-shaped piston and thus the actuator are pulled in the direction of the coupler chamber, thus lengthening the opening travel of the injection valve member.

The actuator is preferably surrounded by a spring element, which is braced by one side against a plate embodied on the injection valve member and by the other side against the bottom of the cup-shaped piston.

In the control chamber, which is embodied in the cup-shaped piston, a second spring element is preferably received, which is braced by one side against the face end of the piston that defines the control chamber and by the other side against the inside of the bottom of the cup-shaped piston.

In a further embodiment of the fuel injector embodied according to the invention, the first control chamber is laterally defined by a sleeve. Besides the coupler chamber, the sleeve surrounds a piston, which is in communication with the actuator on the side remote from the injection valve member. Upon an increase in length of the actuator or upon contraction of the actuator, the piston is guided in the sleeve. By the use of the sleeve, with which an axial offset occurring in manufacture can be compensated for, the influences of production variations on the operation of the fuel injector are lessened. This also increases the transmission rigidity and makes a fast needle motion possible.

The sleeve is moved into a sealing seat in the injector housing by means of a spring element, which is braced by one side against an enlargement on the piston and by the other side against the sleeve. As the sealing seat, a flat seat or a cutting edge is for instance suitable. As a result, fuel is prevented from being able to escape from the coupler chamber defined by the sleeve at the connection point between the housing and the sleeve. By the use of the sleeve to define the coupler chamber, the assembly and production of the fuel injector are simplified. Since the sleeve in which the piston is guided is positioned upon assembly at the correct position inside the injector housing, it is unnecessary to manufacture an exactly positioned guide for the piston in the housing. The necessity of double guidance of the injection valve member and actuator unit over a plurality of components, which cannot be mastered in terms of production, is thus dispensed with.

In a preferred embodiment, two sealing seats are embodied on the injection valve member; one sealing seat is located above and one sealing seat below the injection opening. Upon opening of the injection valve member, the two sealing seats are essentially uncovered simultaneously. As a result, unthrottling of the nozzle is already achieved at only a short stroke of the injection valve member, which is achieved directly by a short piezoelectric actuator, without requiring a travel boost. The use of a short piezoelectric actuator makes it possible to reduce the costs for the fuel injector.

By the use of the sleeve with which the first control chamber is used, the double guidance of the injection valve member and actuator unit over a plurality of components is dispensed with. An axial offset occurring in production can be compensated for by means of the sleeve.

The disposition of a coupler chamber on the side of the actuator remote from the injection valve member makes a direct mechanical connection possible between the actuator and the injection valve member, and as a result the transmission rigidity is increased and a fast needle motion is made possible.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
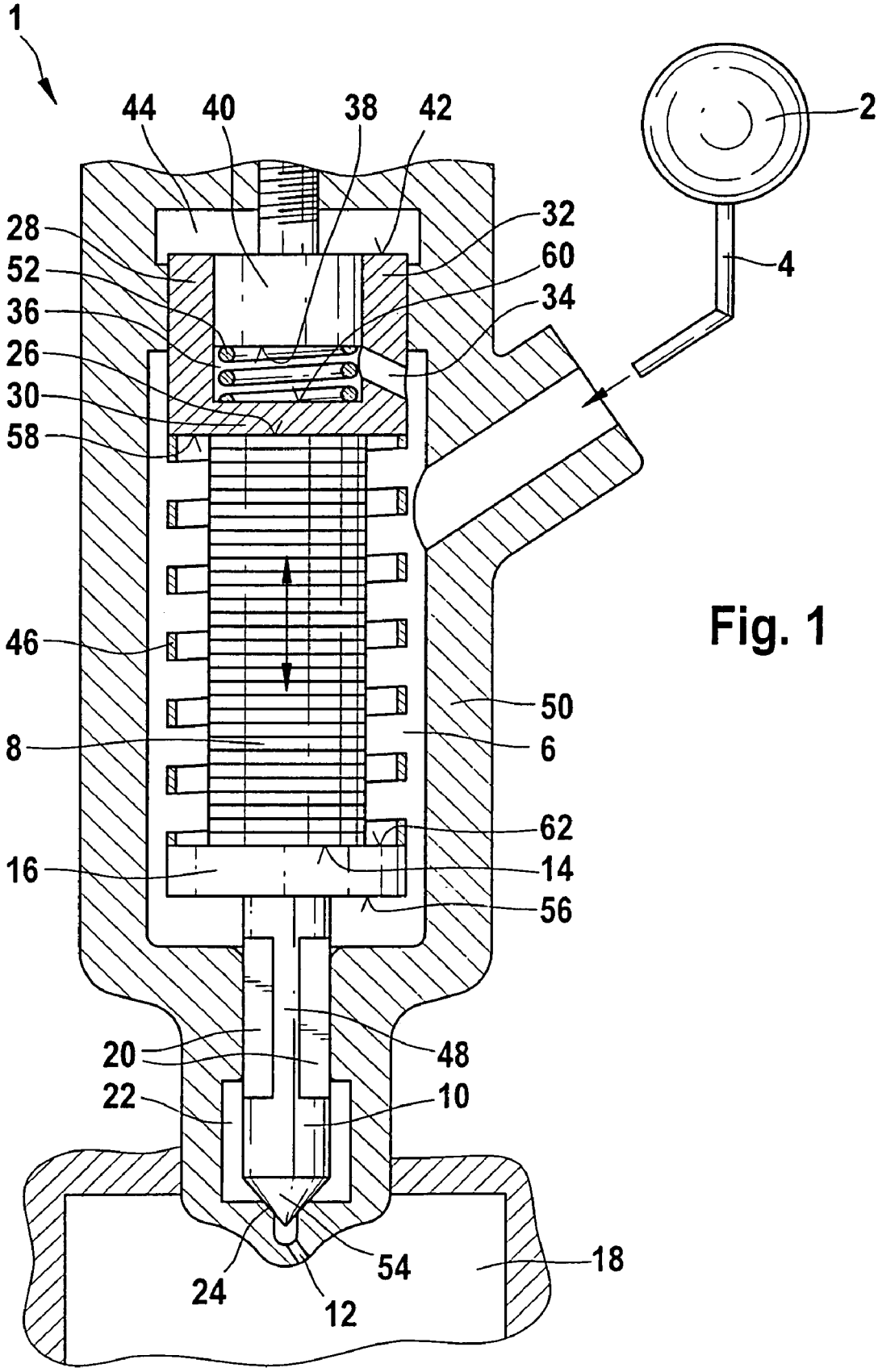
FIG. 1 shows a fuel injector embodied according to the invention in a first embodiment.

In FIG. 1, a fuel injector 1 embodied according to the invention is shown in a first embodiment. The fuel injector 1 is supplied with fuel, which is at system pressure, from a high-pressure reservoir 2 via a fuel inlet 4. The fuel that is at system pressure enters an actuation chamber 6, in which an actuator 8, preferably a piezoelectric actuator, is received. With the aid of the actuator 8, an injection valve member 10, which may be embodied for instance as a nozzle needle, is triggered, and with it at least one injection opening 12 is opened or closed. To that end, the injection valve member 10 adjoins the actuator 8 directly, and the actuator 8 acts with the end face 14 toward the nozzle needle on a plate 16 embodied on the injection valve member 10.

For supplying a combustion chamber 18 of an internal combustion engine with fuel, the fuel that is at system pressure flows along flat faces 20, embodied in the injection valve member 10, into an annular chamber 22 surrounding the injection valve member 10. On the side toward the at least one injection opening 12, a seat 24 is embodied in the annular chamber 22; this seat can be closed or opened by the injection valve member 10. As soon as the seat is opened, the fuel that is at system pressure flows out of the annular chamber 22 via the at least one injection opening 12 into the combustion chamber 18.

On a side 26 remote from the injection valve member 10, a cup-shaped piston 28 adjoins the actuator 8. To that end, the bottom 30 of the cup-shaped piston 28 is in contact with the side 26 of the actuator 8. In the preferably cylindrically embodied wall 32 of the cup-shaped piston 28, at least one inlet opening 34 is embodied, by way of which fuel at system pressure flows into a control chamber 36 embodied in the interior of the cup-shaped piston 28. On the side diametrically opposite the bottom 30 of the cup-shaped piston 28, the control chamber 36 is defined by an end face 38 of a piston 40. With an annular end face 42—which for a cup-shaped piston 28 is of circular cross section—the cup-shaped piston 28 discharges into a coupler chamber 44.

The actuator 8 is surrounded by a first spring element 46, which is secured by one side to the plate 16 of the injection valve member 10 and by the other side to the bottom 30 of the cup-shaped piston 28. Via the first spring element 46, an initial tension is thus exerted on the actuator 8, which is preferably embodied as a piezoelectric actuator. The first spring element 46 is preferably embodied as a tube spring.

A radial motion of the injection valve member 10 is avoided by providing that guide portions 48 are embodied between the flat faces 20. With the guide portions 48, the injection valve member 10 is guided in the injector housing 50.

In the embodiment shown in FIG. 1, a second spring element 52 is received in the control chamber 36; it is braced by one side against the inside of the bottom 30 of the cup-shaped piston 28 and by the other side against the end face 38 of the piston 40. The second spring element 52 is preferably a compression spring embodied as a spiral spring.

In the state of repose, or in other words in the interval between two injection events, the injection valve member 10 is in its seat 24 and thus closes the at least one injection opening 12. To that end, the actuator 8 embodied as a piezoelectric actuator is supplied with current and is thus stretched in the axial direction. To start the injection event, the voltage is withdrawn from the actuator 8, causing it to contract. As a result, the cup-shaped piston 28 is moved in the direction of the injection valve member 10. The annular end face 42 moves out of the coupler chamber 44, so that the volume in the coupler chamber 44 is increased. As a result, the pressure in the coupler chamber 44 drops. The motion of the cup-shaped piston 28 is reinforced by the second spring element 52 in the control chamber 36. Simultaneously, as a result of the contraction of the actuator 8, the injection valve member 10 is lifted from its seat 24, and the at least one injection opening 12 is thus uncovered, so that fuel at system pressure is injected out of the annular chamber 22 via the at least one injection opening 12 into the combustion chamber 18 of the engine. The decreasing pressure in the coupler chamber 44 causes the pressure force acting on the annular face end 42 of the cup-shaped piston 28 to decrease. Since the actuation chamber 6 is in communication with the high-pressure reservoir 2, the pressure in the actuation chamber 6 does not decrease, even when the injection opening 12 is open. Because of the pressure difference between the actuation chamber 6 and the coupler chamber 44 and the resultant difference in the pressure forces, the structural unit, which includes the cup-shaped piston 28, the actuator 8, and the injection valve member 10, is moved in the direction of the coupler chamber 44. The difference in the pressure forces is due to the pressure forces that act axially in the direction of the coupler chamber 44 and the pressure forces that act axially in the direction of the at least one injection opening 12. The pressure forces acting axially in the direction of the coupler chamber 44 are those that act on the needle tip 54, the underside 56 of the plate 16, and the outer face 58 of the bottom 30 of the cup-shaped piston 28. The pressure forces acting axially in the direction of the injection valve member are those that act on the annular end face 42 of the cup-shaped piston 28, the inside 60 of the bottom 30 of the cup-shaped piston 28, and the top 62 of the plate.

For closing the at least one injection opening 12, the actuator 8 is supplied with current again. As a result, the actuator 8 stretches axially. The stretching axially causes the injection valve member 10 to be moved in the direction of the seat 24. At the same time, the cup-shaped piston 28 is moved in the direction of the coupler chamber 44. As a result, the annular end face 42 of the cup-shaped piston 28 simultaneously moves into the coupler chamber 44, decreasing its volume and causing the pressure in the coupler chamber 44 to rise. Because of the rising pressure in the coupler chamber 44, an additional pressure force is exerted on the cup-shaped piston 28, causing the latter to move in the direction of the at least one injection opening 12. As a result, the closing of the fuel injector 1 is accelerated. As soon as the injection valve member 10 is in its seat 24, the injection event is ended.

Figure 2:
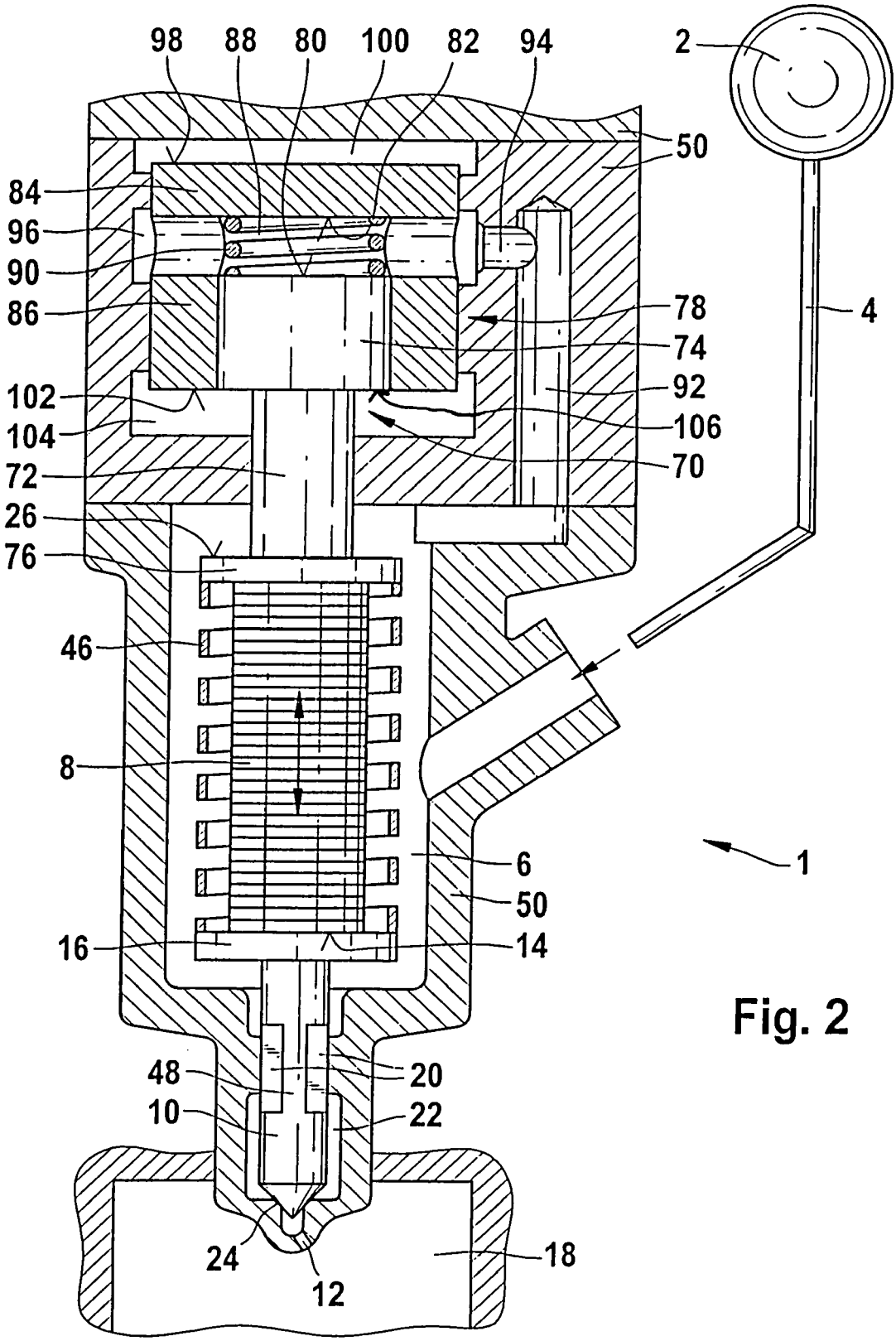
FIG. 2 shows a fuel injector embodied according to the invention in a second embodiment.

FIG. 2 shows a fuel injector of the invention in a second embodiment. In the region of the injection valve member, the embodiment shown in FIG. 2 corresponds to that shown in FIG. 1. Also in the embodiment shown in FIG. 2, the injection valve member 10 is triggered directly by the actuator 8, preferably embodied as a piezoelectric actuator. In the embodiment shown in FIG. 2, the actuator 8 is adjoined, on the side 26 of the actuator 8 remote from the injection valve member 10, by a piston 70, which includes one region of lesser diameter 72, one region of greater diameter 74, and a plate 76; the plate 76 is braced on the face end 26 of the actuator 8.

For prestressing the actuator 8, this actuator is surrounded by the first spring element 46, which is preferably embodied as a tube spring. The first spring element 46 is embodied as a tension spring, which is secured by one side in the plate 16 of the injection valve member 10 and by the other side in the plate 76 of the piston 70.

The region of greater diameter 74 of the piston 70 is embodied on the side of the piston 70 remote from the actuator 8. The region of greater diameter 74 is surrounded by a cup-shaped piston 78, and an end face 80 of the piston 70 remote from the actuator 8, an inner face 82 of the bottom 84 of the cup-shaped piston 78, and the wall 86 of the cup-shaped piston 78 surround a control chamber 88. In the control chamber 88, there is a second spring element 90, which is preferably embodied as a cylindrical helical compression spring; the second spring element 90 is braced by one side against the end face 80 of the piston 70 and by the other side against the inner face 82 of the bottom 84 of the cup-shaped piston 78.

The control chamber 88 communicates hydraulically with the actuation chamber 6 via a connecting conduit 92 and at least one inlet opening 94. Via the connecting conduit 92 and the inlet opening 94, the control chamber 88 is supplied with fuel that is at system pressure. In the embodiment shown in FIG. 2, the connecting conduit 92 discharges into an annular conduit 96, from which the at least one inlet opening 94 in the wall 86 of the cup-shaped piston 78 branches off.

With an end face 102 that is annular—if the cup-shaped piston 78 has a circular cross section—the cup-shaped piston 78 defines a coupler chamber 104. The annular end face 102 points in the direction of the actuator 8. An end face 106, also pointing in the direction of the actuator 8, of the region of greater diameter 74 of the piston 70 likewise defines the coupler chamber 104. With the outer face 98 of the bottom 84, the cup-shaped piston 78 also defines a second control chamber 100.

The actuator 8 is not supplied with current in the state of repose, or in other words when the injection openings 12 are closed. For opening the injection openings 12, current is supplied to the actuator 8. As a result, the actuator stretches. Because of the expansion of the actuator 8, the piston 70 is moved in the direction of the cup-shaped piston 78. As a result, the end face 106 on the region of greater diameter 74 of the piston 70 moves out of the coupler chamber 104. The volume of the coupler chamber 104 increases. Because of the increasing volume in the coupler chamber 104, the pressure drops. As a result, the cup-shaped piston 78 moves in the direction of the coupler chamber 104. At the same time, the outer face 98 of the cup-shaped piston 78 moves out of the second control chamber 100. This causes a pressure decrease in the second control chamber 100, as a result of which the entire unit including the cup-shaped piston 78, the piston 70, the actuator 8, and the injection valve member 10 is moved in the direction of the second control chamber 100. As a result, the injection valve member 10 is lifted out of the seat 24 and uncovers the at least one injection opening 12.

For terminating the injection event, the current supply to the actuator is withdrawn. The actuator 8 contracts, causing the piston 70, reinforced by the second spring element 90, to move in the direction of the coupler chamber 104. Since both the piston 70 and the injection valve member 10 are in contact with the actuator 8, the actuator 8 and the injection valve member 10 move together with the piston 70 in the direction of the at least one injection opening 12. The motion in the direction of the at least one injection opening 12 is ended as soon as the injection valve member 10 in its seat 24 and has thus closed the at least one injection opening 12.

Figure 3:
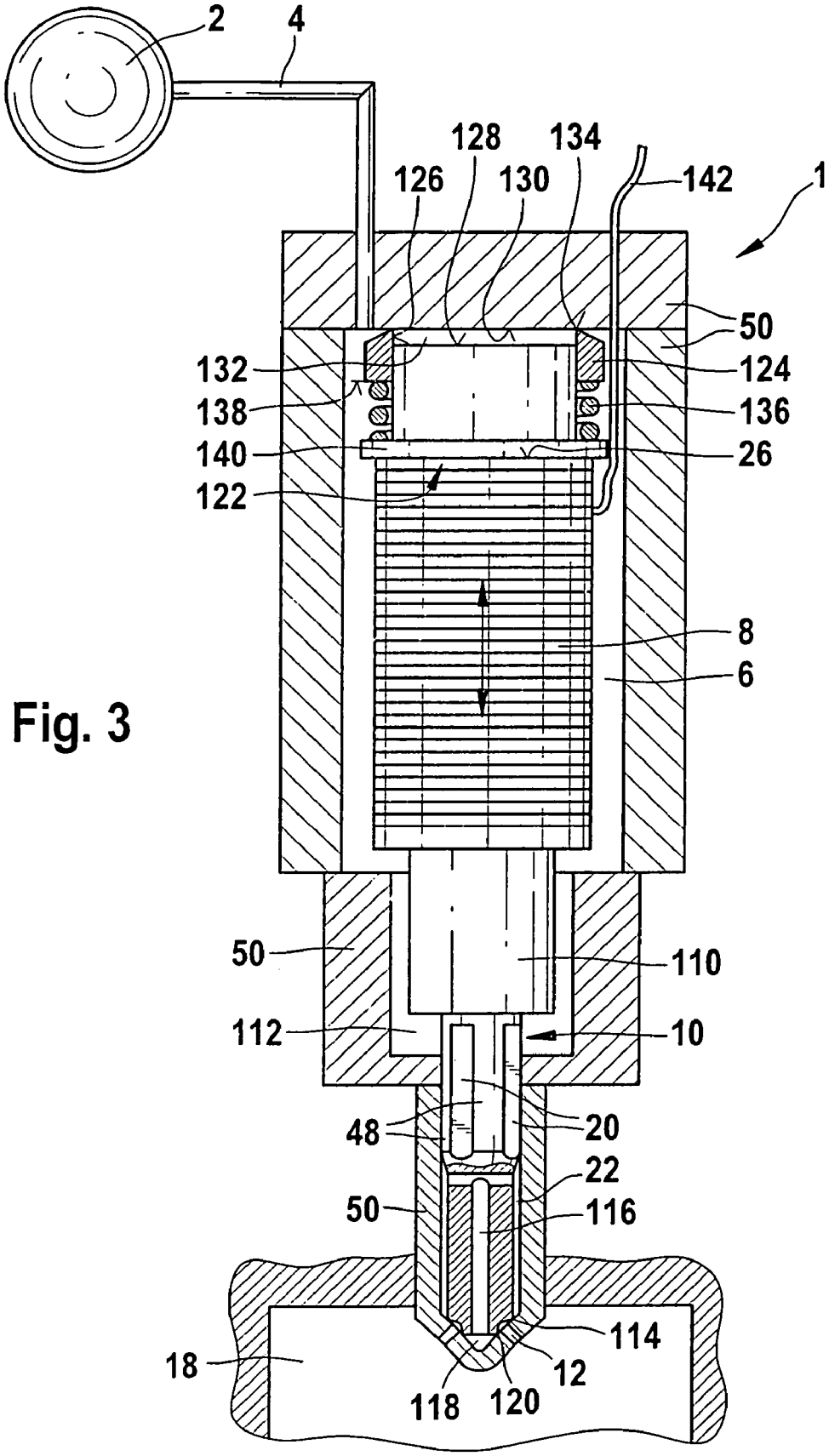
FIG. 3 shows a fuel injector embodied according to the invention in a third embodiment.

FIG. 3 shows a fuel injector of the invention in a third embodiment. In the embodiment shown in FIG. 3, the injection valve member 10 again directly adjoins the actuator 8. The injection valve member 10 includes a region of greater diameter 110, which is adjoined by a region with flat faces 20.

The region of greater diameter 110 is surrounded by a pressure chamber 112. Via the flat faces 20, the pressure chamber 112 communicates hydraulically with the annular chamber 22, which surrounds the injection valve member 10 between the region with the flat faces 20 and a first seat 114 for closing the at least one injection opening 12. In the region of the annular chamber 22, a flow conduit 116 is received in the injection valve member 10, in the embodiment shown here. Via the flow conduit 116, a nozzle chamber 118 is supplied with fuel. So that no fuel will escape from the nozzle chamber 118 to the injection openings 12 when the injection valve member 10 is closed, the injection valve member 10 is located, when the injection openings 12 are closed, in a second seat 120 that is located between the nozzle chamber 118 and the injection openings 12. To prevent a radial motion in the opening and closing process of the injection valve member 10, the injection valve member 10 is guided in the injector housing 50 with the guide portions 48.

The side 26 of the actuator 8 diametrically opposite the injection valve member 10 is adjoined by a piston 122. In the region remote from the actuator 8, the piston 122 is surrounded by a sleeve 124 in such a way that by means of the inner face 126 of the sleeve 124, the end face 128 of the piston 122 remote from the actuator 8, and a radially extending inner wall 130 of the injector housing 50, a coupler chamber 132 is defined. To seal off the coupler chamber 132 from the actuation chamber 6, the sleeve is provided with a sealing face 134, with which the sleeve 124 is pressed against the inner wall 130 of the injector housing 50. To achieve a pressuretight seal, the sealing face 134 is embodied for example as a bite edge. The sleeve 124 is pressed into a sealing seat on the injector housing 50 with the aid of a spring element 136, which is pressed by one side against the end face 138 of the sleeve 124 diametrically opposite the sealing face 134 and by the other side against a plate-shaped enlargement 140 on the piston 122.

The task of the coupler chamber 132 is to compensate for temperature expansions and production variations. Filling the coupler chamber 132 can be done for instance via a leak fuel flow between the piston 122 and the sleeve 124. A throttle can also be embodied in the sleeve 124, by way of which throttle the coupler chamber 132 is filled.

The actuation chamber 6 communicates with the high-pressure reservoir 2 via the fuel inlet 4 and is thus supplied with fuel that is at system pressure. The actuation chamber 6 communicates with the pressure chamber 112, so that the latter is also filled with fuel at system pressure. The fuel at system pressure passes along the flat faces 20 on the injection valve member 10 onward into the annular chamber 22 and via the flow conduit 116 into the nozzle chamber 118.

When the injection openings 12 are closed, the actuator 8 is supplied with a voltage via an electrical line 142. The actuator 8 supplied with current is stretched out. For opening the injection openings 12, the current supply is ended; the actuator 8 contracts in the axial direction. As a result, on the one hand the piston 122 moves in the direction of the actuator 8, thus increasing the volume in the coupler chamber 132. As a result, the pressure in the coupler chamber 132 drops, and the unit comprising the piston 122, actuator 8, and injection valve member 10 is moved back in the direction of the coupler chamber 132. At the same time, because of the shortening of the actuator 8, the injection valve member 10 moves out of its first seat 114 and second seat 120. As a result, the injection openings 12 are uncovered, and fuel at system pressure flows out of the annular chamber 22 and the nozzle chamber 118 via the injection openings 12 into the combustion chamber 18 of the engine.

For terminating the injection event, the actuator 8 is again supplied with current via the electrical line 142. The actuator 8 stretches; as a result, the piston 122 moves into the coupler chamber 132, causing the pressure in the coupler chamber 132 to rise. The actuator is moved in the direction of the injection valve member 10. Simultaneously, because of the lengthening of the actuator 8, the injection valve member moves in the direction of the injection openings 12. The injection valve member 10 is placed on its seats 114, 120, and the injection openings 12 are closed.

The advantage of the embodiment having two sealing seats 114, 120 is that two sealing seats, which can also each have a large diameter, are opened simultaneously. As a result, unthrottling of the nozzle is already achieved at a short stroke of the injection valve member 10, and this stroke is achieved directly by a short actuator 8 without requiring a travel boost. As a result, it is possible to use a short piezoelectric actuator, thus reducing the costs for the fuel injector. Because of the direct triggering of the injection valve member 10, a stiff transmission behavior is attained, which improves the switching properties of the fuel injector 1. As a result, it becomes possible to meter very small preinjection quantities exactly. The stiff transmission behavior also makes for a design that is very sturdy against production variations.

It is a common feature of the embodiments shown in FIGS. 1, 2, and 3 that the actuator 8 is received in floating fashion in the actuation chamber 6. This means that the actuator 8 is solidly connected only to the injection valve member 10 and to the pistons 40, 70, 122 located on the side 26.

To avoid damage to the actuator 8, its surfaces are preferably provided with a suitable sealing against the ambient medium.

Besides the embodiments shown in FIGS. 1 and 2 with an injection valve member with a sealing seat 24, it is also possible in the embodiments shown in FIGS. 1 and 2 to use an injection valve member 10 embodied in accordance with the embodiment of FIG. 3, with a first seat 114 and a second seat 120. It is equally possible, in the embodiment shown in FIG. 3, instead of the injection valve member with a first seat 114 and a second seat 120, to use an injection valve member with only one seat 24, as shown in FIGS. 1 and 2.

The foregoing relates to preferred exemplary embodiments of the invention, it being understood that other variants and embodiments thereof are possible within the spirit and scope of the invention, the latter being defined by the appended claims.

We claim:

1. A fuel injector for injecting fuel at high pressure into a combustion chamber of an internal combustion engine comprising: an injection valve member; an actuator acting on the injection valve member to cause said injection valve member to move to a first position in which the injection valve member opens at least one injection opening or to a second position in which the injection valve member closes said at least one injection opening; a coupler chamber filled with fuel that is at system pressure when the injection opening is closed, and wherein the actuator is directly mechanically connected to the injection valve member.

2. The fuel injector as defined by claim 1, wherein the actuator, on the side remote from the injection valve member, is in communication with a piston which acts on the coupler chamber.

3. The fuel injector as defined by claim 2, wherein the piston is a cup-shaped piston; wherein a further piston is received in the cup-shaped piston which further piston defines a control chamber in the cup-shaped piston; and wherein the cup-shaped piston, with an annular end face remote from the actuator, defines the coupler chamber.

4. The fuel injector as defined by claim 3, further comprising a plate on the injection valve member, on the side of the injection valve member oriented toward the actuator, and a first spring element surrounding the actuator, which spring element is braced against the plate of the injection valve member and against the bottom of the cup-shaped piston.

5. The fuel injector as defined by claim 2, wherein the piston, with an end face remote from the actuator, defines a control chamber in a cup-shaped piston; and wherein the cup-shaped piston, with an annular end face oriented toward the actuator, defines the coupler chamber.

6. The fuel injector as defined by claim 5, further comprising plates on the side of the injection valve member oriented toward the actuator and on the side of the piston oriented toward the actuator, and a first spring element secured to each of the plates and surrounding the actuator.

7. The fuel injector as defined by claim 3, further comprising a second spring element received in the control chamber embodied in the cup-shaped piston, the second spring element being braced by one side against the end face of the piston defining the control chamber and by its other side against the inside of the bottom of the cup-shaped piston.

8. The fuel injector as defined by claim 4, further comprising a second spring element received in the control chamber embodied in the cup-shaped piston, the second spring element being braced by one side against the end face of the piston defining the control chamber and by its other side against the inside of the bottom of the cup-shaped piston.

9. The fuel injector as defined by claim 5, further comprising a second spring element received in the control chamber embodied in the cup-shaped piston, the second spring element being braced by one side against the end face of the piston defining the control chamber and by its other side against the inside of the bottom of the cup-shaped piston.

10. The fuel injector as defined by claim 6, further comprising a second spring element received in the control chamber embodied in the cup-shaped piston, the second spring element being braced by one side against the end face of the piston defining the control chamber and by its other side against the inside of the bottom of the cup-shaped piston.

11. The fuel injector as defined by claim 2, further comprising a sleeve guided on the piston, the sleeve laterally defining the coupler chamber.

12. The fuel injector as defined by claim 11, wherein the piston is surrounded by a spring element, which is braced by one side against the sleeve and by the other side against a plate-shaped enlargement of the piston and moves the sleeve into a sealing seat.

13. The fuel injector as defined by claim 12, wherein the sealing seat is embodied as a sealing face or as a bite edge.

14. The fuel injector as defined by claim 1, wherein the injection valve member comprises a double seat for closing the at least one injection opening.

15. The fuel injector as defined by claim 3, wherein the injection valve member comprises a double seat for closing the at least one injection opening.

16. The fuel injector as defined by claim 4, wherein the injection valve member comprises a double seat for closing the at least one injection opening.

17. The fuel injector as defined by claim 5, wherein the injection valve member comprises a double seat for closing the at least one injection opening.

18. The fuel injector as defined by claim 6, wherein the injection valve member comprises a double seat for closing the at least one injection opening.

19. The fuel injector as defined by claim 7, wherein the injection valve member comprises a double seat for closing the at least one injection opening.

* * * * *